US005504941A

United States Patent [19]

Sell

[11] Patent Number: 5,504,941

[45] Date of Patent: Apr. 9, 1996

[54] BIB

[76] Inventor: Nancy Sell, 31299 Gates Mills Blvd., Pepper Pike, Ohio 44124

[21] Appl. No.: 55,913

[22] Filed: Apr. 30, 1993

Related U.S. Application Data

[63] Continuation of Ser. No. 872,338, Apr. 23, 1992, abandoned.

[51] Int. Cl.[6] ..... A41B 13/10; A41D 11/00

[52] U.S. Cl. ..... 2/49.2; 2/49.1; 2/46; 2/247

[58] Field of Search ..... 2/46, 48, 49 R, 2/49 A, 50, 51, 92, 106, 115, 174, DIG. 5, 247, 248, 249, 250, 251, 252

[56] References Cited

U.S. PATENT DOCUMENTS

| | | | |
|---|---|---|---|
| D. 238,521 | 1/1976 | Andersson | 2/49 A X |
| 2,321,116 | 6/1943 | Welch | 2/DIG. 5 X |
| 2,473,740 | 6/1949 | Welch | 2/DIG. 5 X |
| 2,569,915 | 10/1951 | Arseneault | 2/49 R |
| 2,600,557 | 6/1952 | Marriott | 2/174 X |
| 2,629,871 | 3/1953 | Greene | 2/51 |
| 3,146,465 | 9/1964 | Hummel | 2/49 R |
| 4,445,231 | 5/1984 | Noel | 2/49 R |
| 4,663,779 | 5/1987 | Bible | 2/49 R |
| 4,793,004 | 12/1988 | Long et al. | 2/49 R |
| 4,924,527 | 5/1990 | Huntermeyer | 2/49 R |

FOREIGN PATENT DOCUMENTS

| | | | |
|---|---|---|---|
| 1072696 | 9/1954 | France | 2/49 R |
| 1193862 | 11/1959 | France | 2/49 R |
| 1410315 | 8/1965 | France | 2/49 R |
| 1500174 | 9/1967 | France | 2/49 R |
| 295371 | 12/1953 | Switzerland | 2/49 R |
| 206719 | 11/1925 | United Kingdom | 2/49 R |

*Primary Examiner*—Jeanette E. Chapman

*Attorney, Agent, or Firm*—Watts, Hoffmann, Fisher & Heinke Co.

[57] ABSTRACT

An easy-to-clean bib comprises a body, preferably made of a durable, flexible and non-porous material, and has a front and a back. The material is easy to clean and does not allow liquid to leak through as opposed to some bibs that are made of paper, plastic or similar light materials. The body includes two upper sections for placement on opposite sides of a user's neck. The upper sections include cooperative fasteners that fasten the upper sections together and thereby cause a portion of the bib body to bow outwardly in order to conform to the user's chest to help prevent particles and liquid from falling under the bib and onto the user. The bib body further includes a lower section for forming a temporary pouch. The pouch is formed by folding each of two lower comer portions up towards the front of the body and fastening a bottom piece of a cooperative fastener to its corresponding top piece and then fastening a bottom piece of a second cooperative fastener to its corresponding top piece. A front edge of the pouch bulges outwardly, while under the bib body portion that bows outwardly, a portion of the pouch conforms to the user's stomach thereby giving the pouch a trough-like function and appearance. This allows the pouch to catch particles and liquid easily thereby inhibiting the particles and liquid from spilling onto the user or onto the floor or other surface. Additionally, the manner in which the comer portions are folded and snapped helps minimize liquid leakage from the pouch at its corners. The bib can be easily cleaned by dismantling the pouch and quickly wiping along the bib.

7 Claims, 5 Drawing Sheets

BIB

This is a continuation of application Ser. No. 07/872,338 filed on Apr. 23, 1992, now abandoned.

TECHNICAL FIELD

This invention relates generally to protective coverings for clothing, and more particularly to a bib which, in use, has a pouch temporarily formed in its lower section.

BACKGROUND

Bibs are most commonly used while feeding a baby or young child. Bibs are also used by senior citizens and infirm people of all ages. Additionally, bibs are worn by patrons of restaurants.

Typically, bibs are made of cloth or paper and only protect the clothing located directly under a user's bib. Cloth bibs need to be washed and more than one bib may need to be kept on hand for use while other bibs are waiting to be cleaned.

In order to be more effective, some bibs come with permanently formed pouches located at a lower section of the bib. These pouches are intended to trap and catch solids and liquids that are spilled or dropped by the bib's user. A major problem associated with such bibs is the cleaning and upkeep of the bibs.

A proposal for solving the cleaning problem for bibs was a bib which was intended to have a temporary pouch at its lower section thereby allowing the pouch to be opened and easily wiped out and cleaned. A problem associated with this proposal would have been preventing leakage of liquids at the corners. Because the proposal's pouch was temporarily formed by folding up a lower section and bending back of corners, the pouch would not have been generally leak-proof at the corners. The formation of such a pouch could actually defeat the purpose of the bib by allowing liquid to escape at the corners of the temporary pouch.

A problem with some proposals for pouches and those that have been provided is that such a pouch does not project outwardly enough from the body of the bib user and, therefore, fails to adequately catch particles and liquids. A proposal for the pouch problem provides a stiffener within the pouch. Such a stiffener adds to the time of manufacture and cost for the bib and can also make it more difficult to clean by hindering its ability to be laid flat and wiped clean.

Another problem generally associated with bibs is conformity of the bib to the user's body. If the bib does not adequately conform to the body of the user, gaps and openings can appear between the bib and the body of the user wherein particles and liquid can actually miss the bib and come in contact with the user's clothing or body. In such instances, the bib does not achieve its intended effectiveness.

SUMMARY OF THE INVENTION

In accordance with the present invention, an easy-to-clean bib comprises a body, preferably made of a durable, flexible and non-porous material. The material is easy to clean and does not allow liquid to leak through as opposed to some disposable bibs that are made of paper or similar light materials.

The body includes two upper sections for placement on opposite sides of a user's neck. Each upper section defines a segment of a substantially circular aperture. The upper sections include cooperative fasteners that fasten the upper sections together and thereby cause a portion of the bib body to bow outwardly in order to conform to the user's chest. This helps prevent particles and liquid from falling under the bib and onto the user.

The bib body further includes a lower section including two comer portions. The lower section is used for forming a temporary pouch. Two sets of cooperative fasteners are located near opposite side edges of the body. Preferably the fasteners are in the form of snaps. Each snap set has a bottom piece located on the front of a corresponding comer portion and a top piece located on the back of the body near the side edge of the body. Two more sets of cooperative fasteners, preferably in the form of snaps, are located near opposite side edges of the body with each snap set having a bottom piece located on the back of the body near the side edge between the top and bottom pieces of the corresponding first snaps. A top piece is located between the bottom piece of the second set of snaps and the corresponding top piece of the first set of snaps.

The pouch is formed by folding each of the two lower corner portions up towards the front of the body and fastening the bottom piece of the first snap set to its corresponding top piece and then fastening the bottom piece of the second snap set to its corresponding top piece.

The formation of the temporary pouch causes a front edge of the pouch to bulge outwardly, while under the bib body portion that bows outwardly, a portion of the bib forming a back wall of the pouch bows inwardly thereby giving the pouch a trough-like function and appearance. Additionally, the sides of the bib body adjacent and above the pouch bow inwardly and are thereby similar to a funnel. This allows the pouch to catch particles and liquid easily thereby inhibiting the particles and liquid from spilling onto the user or onto the floor or other surface. Additionally, the manner in which the comer portions are folded and snapped helps minimize liquid leakage from the pouch at its comers.

The temporary pouch can be quickly and easily dismantled thereby allowing the bib to be easily cleaned. The bib can be laid flat on a surface and quickly wiped clean.

Accordingly, it is an object of the present invention to provide a new and improved bib which conforms to the user's body and additionally, has a temporary pouch along a lower section of the bib that is virtually leak-proof.

DETAILED DESCRIPTION OF THE PREFERRED EMBODIMENT

Figure 1:
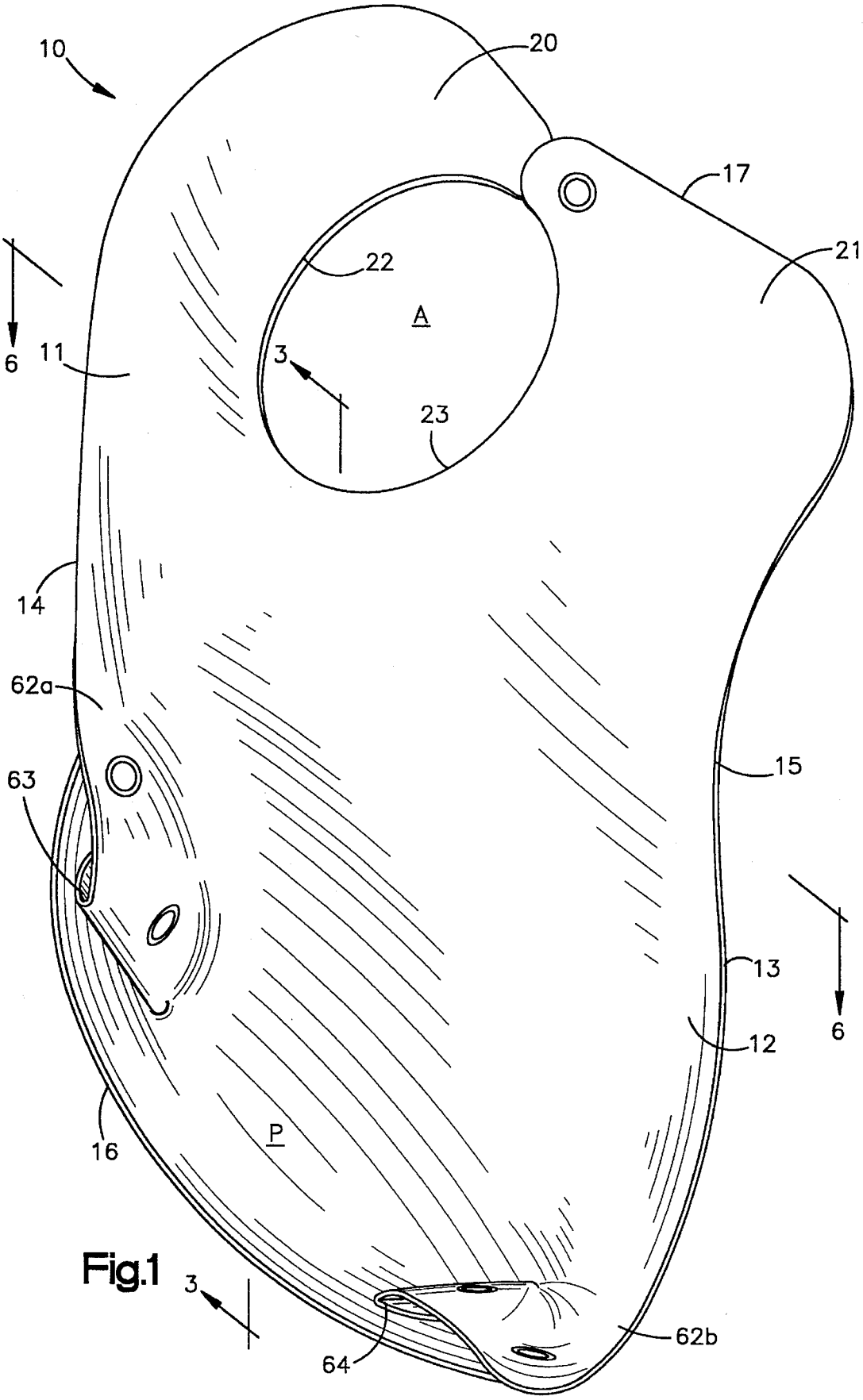
FIG. 1 is a perspective view of a bib embodying the present invention.

Turning to the drawings, a bib 10 is illustrated. The bib 10 has a body 11 that has a front 12 and a back 13. The body 10 further includes two opposing side edges 14, 15 as well as a bottom edge 16 and a top edge 17.

In the preferred embodiment, the body 11 has two upper sections 20, 21. The two upper sections 20, 21 each define a segment 22, 23 of a circular aperture A. The segments 22, 23 are for placement on opposite sides of a user's neck.

Located on the upper sections 20, 21, are cooperative fasteners 24, 25, preferably in the form of snaps. The fasteners 24, 25 are located slightly outward from a respective tip portion 30, 31.

Figure 2:
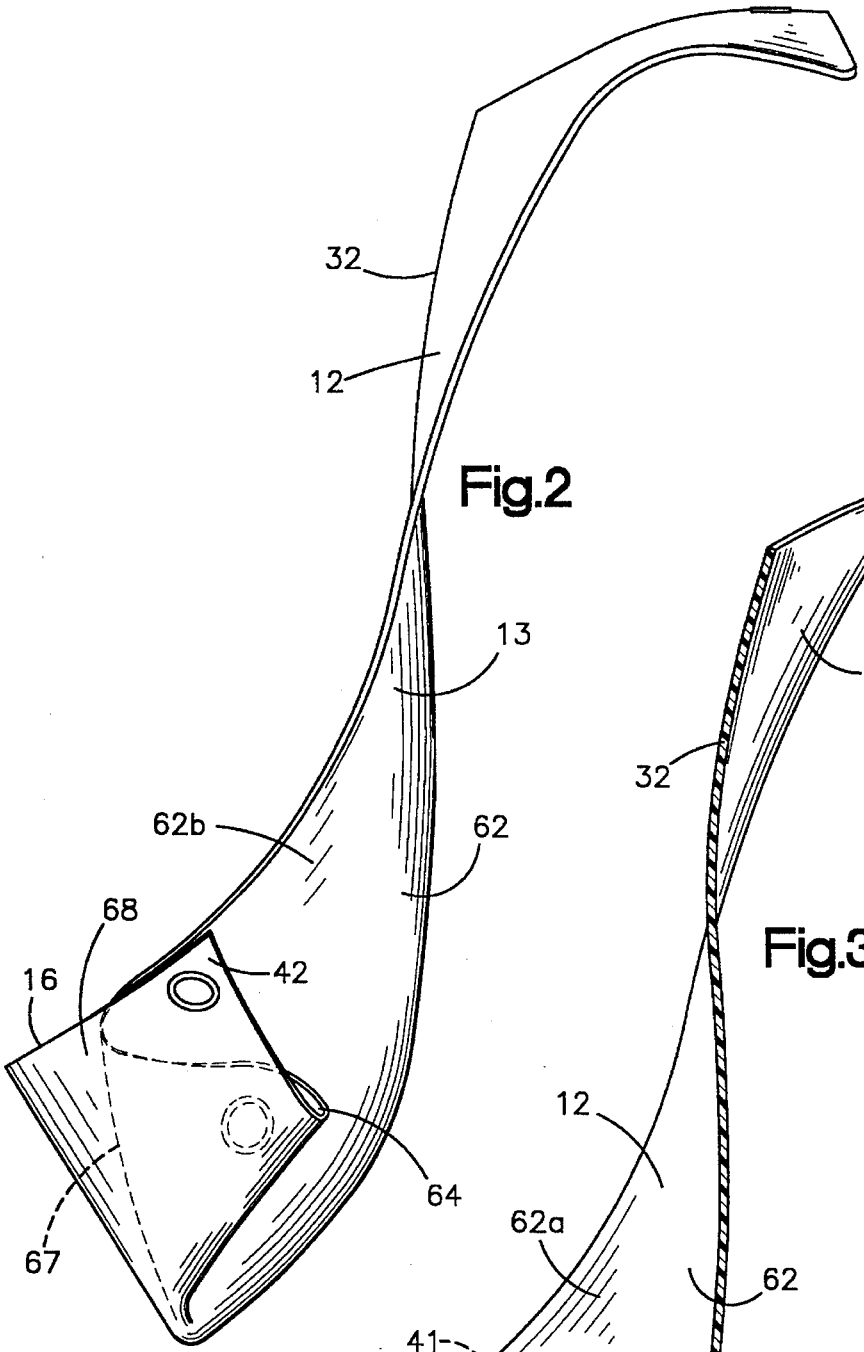
FIG. 2 is a side perspective view of a bib embodying the present invention.
Figure 3:
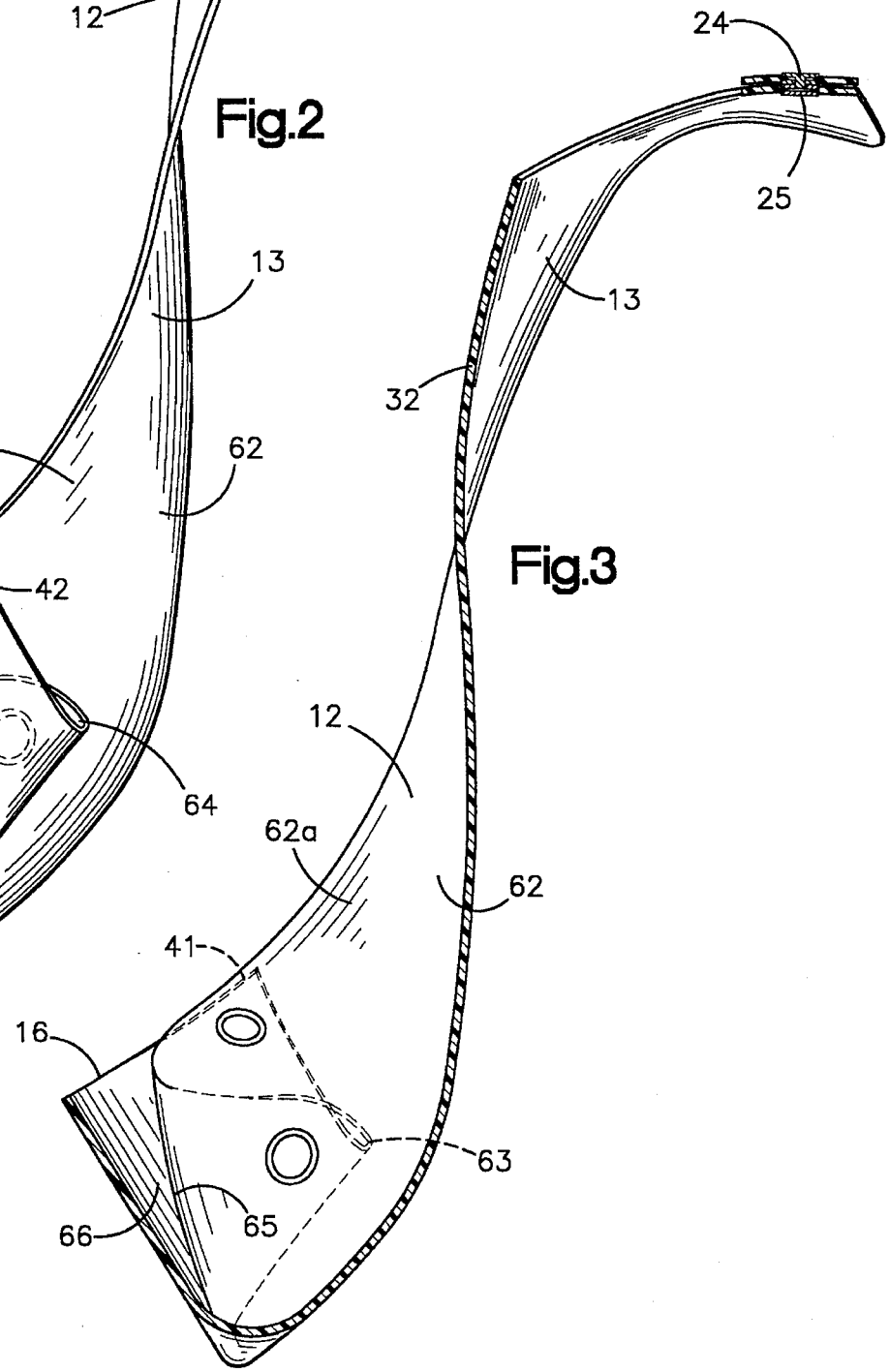
FIG. 3 is a sectional view of a bib embodying the present invention as seen from the plane indicated by the lines 3—3 of FIG. 1.
Figure 5:
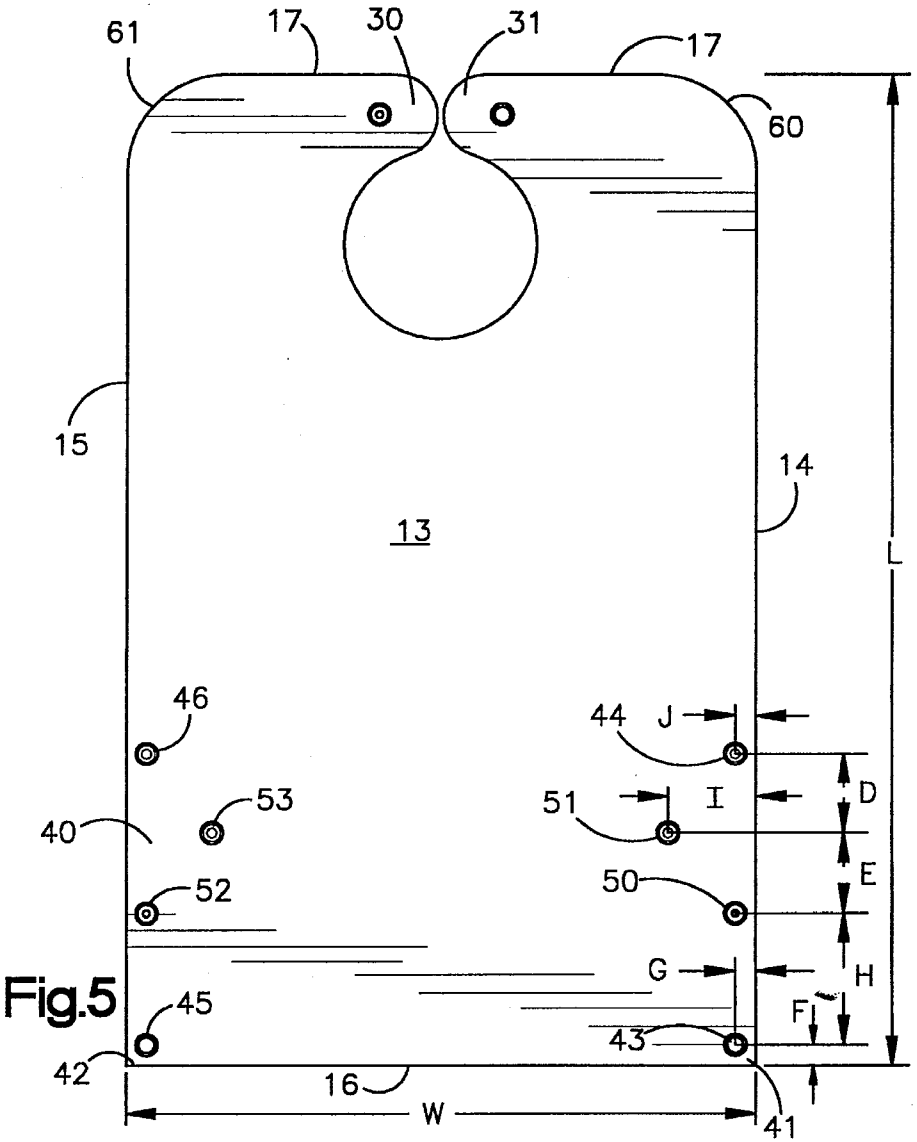
FIG. 5 is a back elevational view of a baby bib embodying the present invention with the temporary pouch unfolded.
Figure 4:
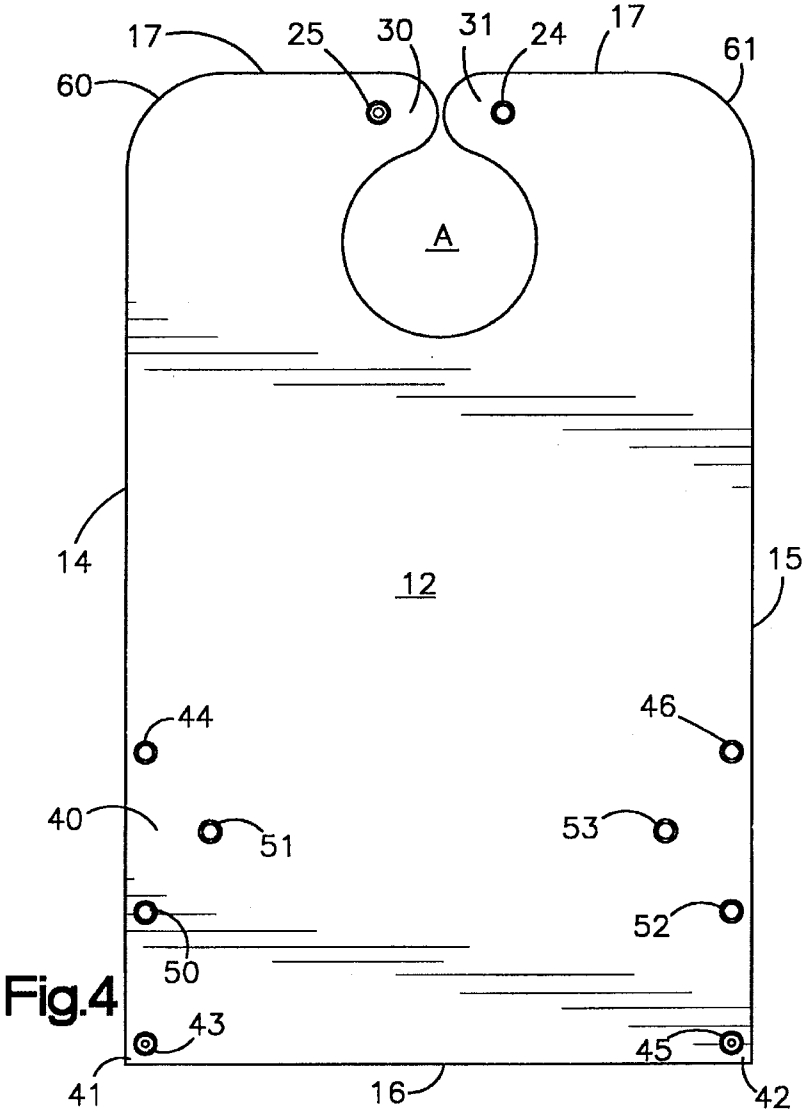
FIG. 4 is a front elevational view of a bib embodying the present invention with the temporary pouch unfolded.
Figure 6:
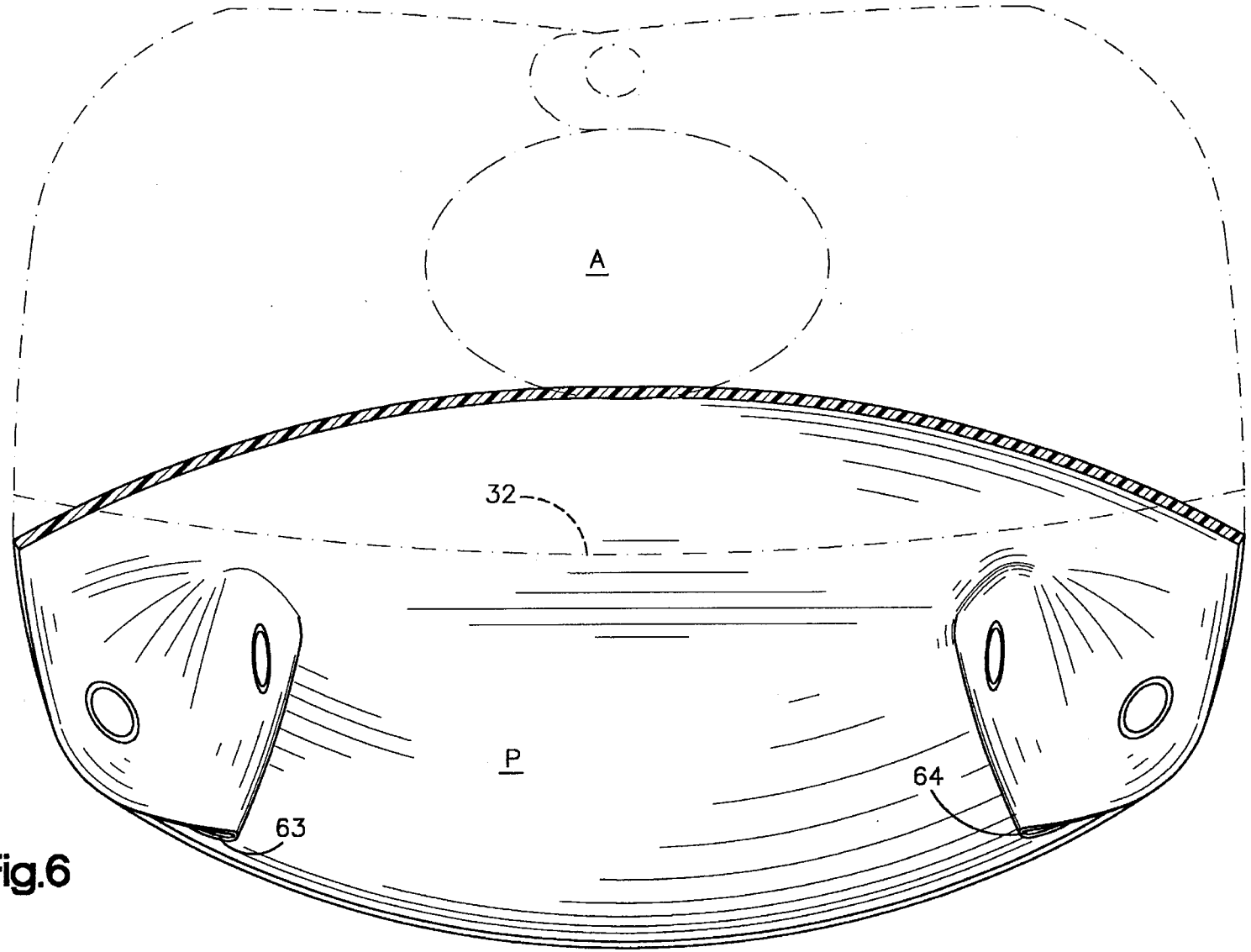
FIG. 6 is a sectional view of a bib embodying the present invention as seen from the plane indicated by the lines 6—6 of FIG. 1 and having the remaining portion of the bib indicated in phantom.
Figure 7:
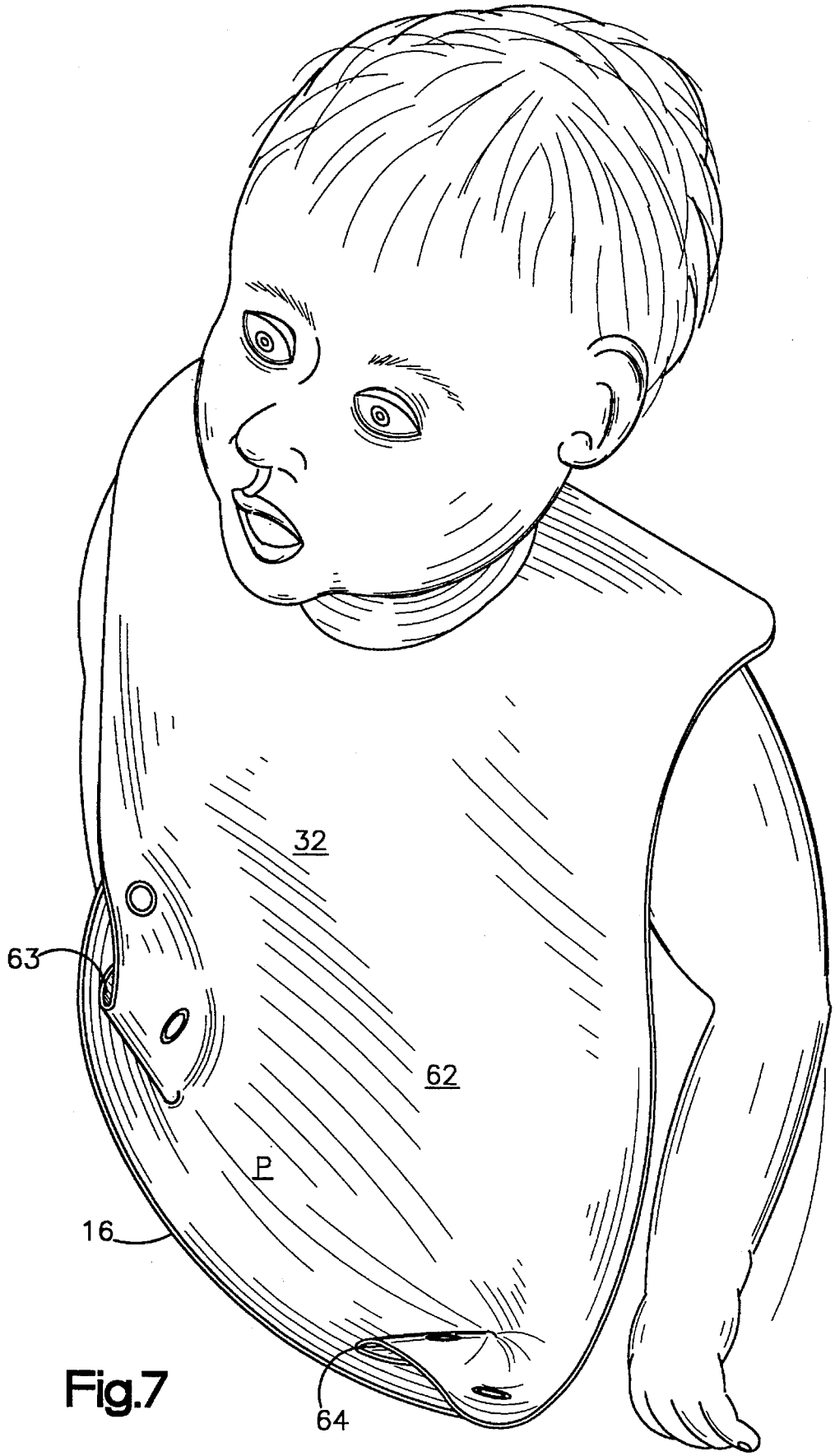
FIG. 7 is a perspective view of a child wearing a bib embodying the present invention.

As best seen in FIGS. 4 and 5, the top edge 17 is substantially straight, and the aperture A is substantially circular when the fasteners 24, 25 are not fastened. However, as best seen in FIG. 1, when the fasteners 24, 25 are fastened together, the top edge i7 is no longer straight and the aperture A becomes substantially elliptical in shape. This is caused by the location of the fasteners 24, 25 away from the tip portions 30, 31, and causes the body 11 to bow outwardly and thereby allows the bib to conform to a user's chest more accurately. The bow of the body 11 is best seen in FIGS. 2 and 3 where it can be clearly seen that a portion 32 of the bib body 11 projects outwardly when the fasteners 24, 25 are fastened together.

By causing the bib body 11 to bow outwardly and thereby conform to a user's body more accurately, the bib I0 serves its purpose of protecting its user from spills more completely. Particles and liquid are inhibited from falling under the bib along its back 13 and thereby onto a user's clothing.

The bib body 11 further includes a lower section 40 having two corners 41, 42. Two sets of cooperative fasteners 43, 44 and 45, 46 are located near the side edges 14, 15. As best seen in FIGS. 4 and 5, the fasteners 43 and 45 are male fasteners and are functionally located on the front 12. The corresponding fasteners 44 and 46 are female fasteners and are functionally located on the back 13.

Two more sets of cooperative fasteners 50, 51 and 52, 53 are located near the side edges 14 and 15. The second set of cooperative fasteners are preferably in the form of snaps. The fasteners 50 and 52 are male fasteners that are functionally located on the back 13. Each fastener 50 and 52 is located between corresponding fasteners 43, 44 and 45, 46. The fasteners 51 and 53 are female fasteners and are functionally located on the back 13. Each fastener 51 and 53 is located between corresponding fasteners 50, 52 and 44, 46. The fasteners 51 and 53 are located inwardly from the corresponding side edges 14 and 15 relative to corresponding fasteners 43, 44, 50 and 45, 46, 52. In the preferred embodiment, the distances indicated by D and E (FIG. 5) are substantially equal.

In the preferred embodiment, the overall length L of the bib is 18 inches while the overall width W of the bib is 11 inches. Distances D & E are 1½ inches each while distances F and G are ⅜ inches each. Distance H is 2⅜ inches while distance I is 1⅝ inches and J is ½ inches. The upper sections 20, 21 each have a respective rounded corner 60, 61 and have the arc of a 3½ inch-circle. The tip portions 30, 31 are rounded and have the arc of a 1½-inch circle. The segments 22, 23 form a circle 3½ inches in diameter.

To form a temporary pouch P, the fasteners 43 and 45 are brought up and around to their corresponding fasteners 44 and 46, and are fastened together with their corresponding fasteners 44 and 46. The fasteners 50 and 52 are then fastened to their corresponding fasteners 51 and 53. As best seen in FIGS. 1, 2, 3, 6 and 7, the bottom edge 16 now forms a top edge of the pouch P and bulges outwardly. As best seen in FIGS. 2 and 3, a portion 62 of the body 11 located under the portion 32 projects inwardly to conform to a user's stomach. The pouch P thereby has a trough-like appearance and function that allows the pouch P to catch particles and liquid more efficiently. Additionally, side portions **62*a*, 62*b*** located adjacent and above the pouch P bow inwardly and are thereby similar to a funnel.

As best seen in FIGS. 2 and 3, the pouch P is virtually leak-proof. In order for liquid to escape the pouch P, the pouch would need to fill with liquid to a level sufficient to reach a portion 63, 64. The liquid would need to flow between portions 65, 66 and/or 67, 68, and continue to flow upwardly in order to reach portions 63, 64.

In order to clean the bib, fasteners 24, 25 are unfastened and the bib is removed from a user. The fasteners 43, 44 and 45, 46, as well as the fasteners 50, 51 and 52, 53 are then unfastened. The bib is then easily wiped off and any contents within the pouch are easily removed. Preferably, the bib is made of a durable, flexible and non-porous material.

While the preferred embodiment of the invention has been illustrated and described in detail, the present invention is not to be considered limited to the precise construction disclosed. Various adaptations, modifications and uses of the invention may occur to those skilled in the art to which the invention relates and the intention is to cover hereby all such adaptations, modifications and uses which fall within the spirit or scope of the appended claims.

I claim:

1. An easy to clean bib comprising:

a. a body, the body having a front and a back, two opposing side edges, a bottom edge and a top edge, and being made of a durable, flexible and non-porous material, the body including:

i. two upper sections for placement on opposite sides of a user's neck and each defining a segment of a substantially circular aperture;

ii. a lower section including two corner portions for forming a temporary pouch;

iii. two sets of first cooperative fastening means located near opposite side edges of the body, each set having a first piece located on the front of a corresponding one of said corner portions and a second piece located on the back of the body near the side edge of the body;

iv. two sets of second cooperative fastening means located near opposite side edges of the body, each set having a first piece located on the back of the body near the side edge between the first and second pieces of corresponding first fastening means, and a second piece located between the first piece of the second fastening means and the corresponding second piece of the first fastening means; and, v. the pouch being formed by folding each of the two lower corner portions up towards the front and fastening the first piece of the first cooperative fastening means to the second piece of the first cooperative fastening means and then fastening the first piece of the second cooperative fastening means to the second piece of the second cooperative fastening means, a front edge of the pouch bulging outwardly to give the pouch a trough-like appearance; and, b. a third cooperative fastening means located on the upper sections, the third fastening means cooperating to fasten the upper sections together and causing the bib body to bow outwardly in order to conform to a user's body.

2. The bib of claim 1 wherein each upper section defines a C-shaped opening for placement adjacent a user's neck.

3. An easy to clean bib comprising a body, the body having a front and a back, two opposing side edges, a bottom edge and a top edge, and being made of a durable, flexible and non-porous material, the body including:

a. an upper section for placement around a person's neck;

b. a lower section including two corner portions for forming a temporary pouch;

c. two sets of first cooperative fastening means located near opposite side edges of the body, each set having a first piece located on the front of a corresponding one of said corner portions and a second piece located on the back of the body near the side edge of the body;

d. two sets of second cooperative fastening means located near opposite side edges of the body, each set having a first piece located on the back of the body near the side edge between the first and second pieces of corresponding first fastening means, and a second piece located between the first piece of the second fastening means and the corresponding second piece of the first fastening means; and, e. the pouch being formed by folding each of the two lower corner portions up towards the front and fasting the first piece of the first cooperative fastening means to the second piece of the first cooperative fastening means and then fastening the first piece of the second cooperative fastening means to the second piece of the second cooperative fastening means, a front edge of the pouch bulging outwardly to give the pouch a trough-like appearance.

4. The bib of claim 3 wherein each upper section defines a C-shaped opening for placement a user's neck.

5. The bib of claim 3 wherein:

a. the upper section includes two parts for placement on opposite sides of a person's neck, each of the upper section parts defining a segment of a substantially circular aperture; and b. further cooperative fastening means located on the upper parts such that when they are fastened together the circular aperture is distorted, the further fastening means thereby cooperating to fasten the upper sections together and causing the bib body to bow outwardly in order to conform to a user's body.

6. An easy to clean reuseable bib comprising:

a. a body, the body being a planaar sheet of a durable, flexible material;

b. the body including:

i. an upper section for placement around a person's neck;

ii. a lower section having a face and a back, the lower section also including two corner portions for forming a temporary pouch from the planar sheet;

iii. sets of cooperative fastening means located in the corner portions, said fastening means sets being interconnectable to join folded parts of each of the portions together with a lower part of the lower section folded upwardly and outwardly spaced from the remainder of the lower section to delineate sides of a pouch, end portions of the pouch being delinerated by the folded and joined parts of the portions said parts of each corner portion includung at least one face to back connection whereby to provide substabtially fluid-tight pouch end portions; and c. the fastening means being releasable for returning the body to its planar condition to facilitate cleaning and storage of the bib.

7. The bib of claim 6 wherein:

a. the upper section includes two parts for placement on opposite sides of a person's neck, each of the upper section parts defining a segment of a substantially circular aperture; and b. further cooperative fastening means located on the upper section parts such that when they are fastened together the circular aperture is distorted, the further fastening means thereby cooperating to fasten the upper sections together and cause the bib body to bow outwardly in order to conform to a use's body.

* * * * *